United States Patent [19]

Yates et al.

[11] Patent Number: 4,704,752

[45] Date of Patent: Nov. 10, 1987

[54] BOX SPRING ASSEMBLY WITH MODULAR TWIN CONTINUOUS SPRING ELEMENTS

[75] Inventors: Chester R. Yates; Maurice M. Bruner, both of Carthage, Mo.

[73] Assignee: Leggett & Platt, Incorporated, Carthage, Mo.

[21] Appl. No.: 834,903

[22] Filed: Feb. 28, 1986

[51] Int. Cl.[4] ..... A47C 23/02; A47C 23/04

[52] U.S. Cl. ..... 5/247; 5/255; 5/268

[58] Field of Search ..... 5/247, 255, 476, 267, 5/268

[56] References Cited

U.S. PATENT DOCUMENTS

| | | | |
|---|---|---|---|
| 240,919 | 5/1881 | Mix | 5/268 |
| 2,773,543 | 12/1956 | Sandor . | |
| 3,248,745 | 5/1966 | Gunlock | 5/255 |
| 3,487,480 | 1/1970 | Slominski . | |
| 3,561,021 | 2/1971 | Slominski | 5/476 |
| 3,574,240 | 4/1971 | Slominski . | |
| 3,574,241 | 4/1971 | Slominski . | |
| 3,722,013 | 3/1973 | Surletta . | |
| 3,755,833 | 9/1973 | Slominski . | |
| 3,761,972 | 10/1973 | Bihun et al. | 5/247 |
| 3,825,960 | 7/1974 | Inman et al. . | |
| 3,827,090 | 8/1974 | Roe | 5/476 |
| 3,833,948 | 9/1974 | Surletta et al. . | |
| 3,852,838 | 12/1974 | Slominski et al. . | |
| 3,971,081 | 7/1976 | Poe . | |
| 4,000,531 | 1/1977 | Inman . | |
| 4,012,802 | 3/1977 | Hutchinson et al. . | |
| 4,060,862 | 12/1977 | Kitchet et al. . | |
| 4,068,329 | 1/1978 | Gross et al. . | |
| 4,068,330 | 1/1978 | Rakow et al. . | |
| 4,101,993 | 7/1978 | Yates et al. . | |
| 4,120,058 | 10/1978 | Kitchen et al. . | |
| 4,129,908 | 12/1978 | Wagner . | |
| 4,186,223 | 1/1980 | Hancock . | |
| 4,195,376 | 4/1980 | Kitchen . | |
| 4,218,790 | 8/1980 | Mizelle | 5/247 |
| 4,238,861 | 12/1980 | Mizelle | 5/255 |
| 4,251,892 | 2/1981 | Hancock . | |
| 4,253,208 | 3/1981 | Hancock et al. . | |
| 4,339,834 | 7/1982 | Mizelle . | |
| 4,371,152 | 2/1983 | Kitchen et al. . | |
| 4,377,279 | 3/1983 | Schulz, Jr. et al. | 5/247 |
| 4,389,705 | 8/1983 | Mizelle | 5/247 |
| 4,452,438 | 6/1984 | Hancock et al. . | |
| 4,470,584 | 9/1984 | Mizelle . | |
| 4,475,724 | 10/1984 | Hancock | 5/247 |
| 4,510,635 | 4/1985 | Woffendin . | |
| 4,555,097 | 11/1985 | Hiatt | 5/247 |
| 4,666,136 | 5/1987 | Hagemeister | 5/255 X |

*Primary Examiner*—Alexander Grosz
*Assistant Examiner*—Carl M. DeFranco, Jr.
*Attorney, Agent, or Firm*—Wood, Herron & Evans

[57] ABSTRACT

A box spring assembly having modular spring elements distributed in an array beneath rectangular pockets of a wire grid top. The elements include a single piece of wire formed into a head configured to support and be contained within selected pockets of the wire grid top, a base formed of the two ends of the wire to attach to a lower base frame, and a pair of compressible arms formed into a pattern of bars and bends which give firm elastic support with economy of wire.

9 Claims, 8 Drawing Figures

BOX SPRING ASSEMBLY WITH MODULAR TWIN CONTINUOUS SPRING ELEMENTS

This invention relates to box spring assemblies, and more particularly, to box spring assemblies having improved modular, non-circular spring elements which can be substituted for coil spring elements on a one-for-one basis.

Box spring assemblies which are used to support mattresses and bedding combinations may be divided into two types. The first type, and the one to which this invention relates, provides distributive elastic support for the mattress or bedding load through an array of discretely acting, vertically compressible spring elements. Historically, the most common spring element of this type has been the traditional coil spring in one form or another.

The second type of box spring assembly employs torsion bar or so-called "fishmouth" spring elements which utilize somewhat different principles than that of the coil spring. In this latter type, the individual spring elements employ transverse torsion bars or spaced arms or some other design of somewhat more specialized geometry, many of which have more than one independently compressible vertical arm. The latter category usually includes assemblies with components which are unique to the particular assembly design and cannot be interchanged with other spring designs. Accordingly, improvements made in such designs cannot be adapted to other assembly configurations, and accordingly, are restricted to specialized and custom construction of other components in the assembly often providing greater, and sometimes prohibitive, costs.

It has been a principal objective of the present invention to provide a box spring assembly in which the individual spring elements have improved spring characteristics and employ an efficient use of the spring wire material, and which are capable of substitution on a one-for-one basis with springs of the coil type.

It is a further objective of the present invention to provide a box spring assembly having spring elements which require a reduced amount of wire to achieve desirable spring characteristics.

It has been a further objective of the invention to provide in a box spring assembly an improved spring element having a wide elastic range and a capability of recovering from extreme compression without suffering a permanent deformation, providing a firm support or a bedding load, and doing so with an economy of wire material in its manufacture.

In accordance with the principles of the present invention, an integrally formed wire spring element is employed for arrangement in an array in a box spring assembly with the wire of the element formed into a head at the central portion of the wire, formed into a base out of both ends of the wire, and formed into a pair of arms between the head and each of the ends which form the base. The arms are formed into a series of straight bars which function as torsion bars and bending members to provide resilient elastic support between the head and the base. Accordingly, the arms of each of the spring elements, when oriented vertically and arranged in an array on a box spring assembly frame to support a wire grid above the frame, compress elastically together in relation to the deflection of the grid at the point above the head of that spring element. The elements include a plurality of these straight bars which are angled with respect to both the vertical and horizontal to achieve both maximum extension of the spring elements for the amount of wire required and optimal elastic deformation of the elements in relation to the vertical loads.

In the embodiments of the invention specifically illustrated, the invention employs the advantages of the vertically angled bars in the arms of the spring elements, right-angled relationships between adjacent bars of the elements, symmetrical and spaced deployment of the two arms of the element so that they function together in relation to singular motion of the element head, and an element head of a generally U-shaped form.

In two specific embodiments of spring elements incorporating principles of the invention, as illustrated in the drawings, each of the arms of the elements is formed into five bars. In one of these five-bar element embodiments, the bars are all inclined or angled with respect to both the vertical and the horizontal and with respect to the other bars of the element arm. In another embodiment of the five-bar element, two of the bars are horizontally oriented and parallel to each other to function as torsion bars, and the other three bars are angled, one to join the two horizontal torsion bars together, and the other two to join the torsion bars with the head and base of the element.

The advantages of the specific embodiments illustrated are that they provide a wide range of elastic deformation, a firm support to an overlying bedding load, an economy of wire material, and are interchangeable with other modular spring elements, including coil springs, on a one-to-one basis in a given box spring assembly.

These and other objectives and advantages of the present invention will be more readily apparent from the following detailed description of the drawings illustrating a box spring assembly and spring module design according to the principles of the present invention, in which:

FIG. 3A illustrates one novel embodiment embodying a first novel spring element of the present invention, while FIG. 3B illustrates a second novel embodiment embodying a second novel spring element of the present invention.

Figure 1:
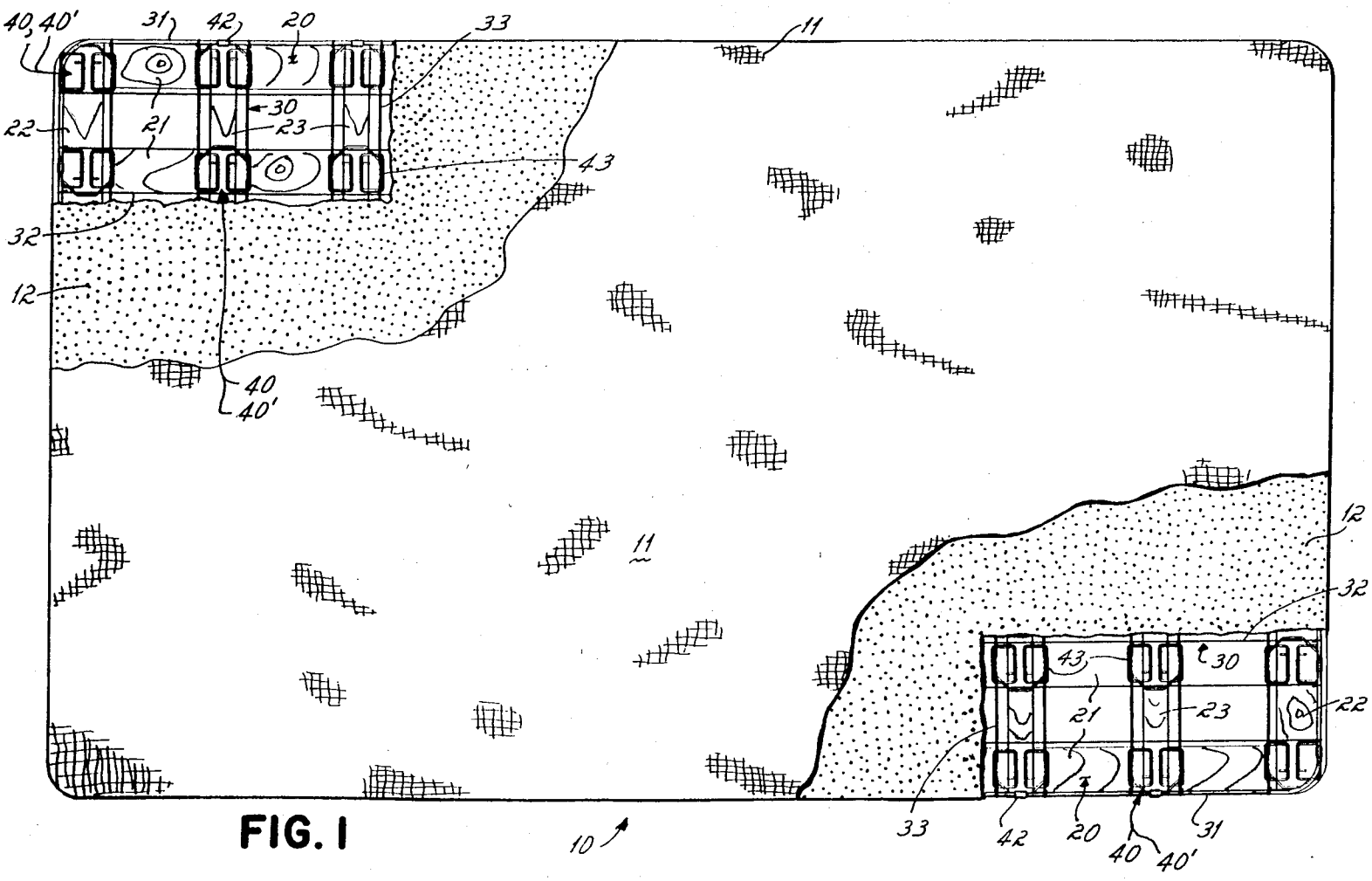
FIG. 1 is a plan view of a box spring assembly embodying principles of the present invention with sections cut away to show the internal components of the assembly.

Referring to FIG. 1, a box spring assembly 10 is illustrated. The box spring assembly 10 is covered by an upholstery covering material 11 against which a mattress will be set and resiliently supported by the box spring assembly 10. Underlying the cover 11, as a cutaway section of FIG. 1 shows, is a pad or matting material 12 which effectively pads the internal structural components of the assembly beneath.

Referring to the cutaway sections of FIG. 1, the box spring assembly 10 includes a lower horizontal, rectangular base frame 20, usually made of wood. The frame includes a pair of heavier longitudinal edge boards 21, a pair of similarly heavy transverse end boards 22, and a plurality of regularly spaced lighter cross members or slats 23. The transverse end boards 22 and slats 23 overlie the longitudinal edge boards 21 and are rigidly attached thereto.

Overlying the frame 20 and lying in a horizontal plane uniformly spaced above the frame 20 is a welded wire grid 30. The grid 30 is generally the same rectangular shape as is the frame 20. It comprises a heavy rectangular border wire 31 which is formed in a closed loop about the boundary of the grid directly above and approximately coinciding with the outer edge of the base frame 20. Extending between opposite sides of the border wire 31 are a plurality of grid wires which include multiple sets or pairs of longitudinal wires 32 and multiple sets or pairs of transverse wires 33. The longitudinal wires 32 extend between and are welded or otherwise secured to opposite ends of the border wire 31. The transverse wires 33 are similarly arranged in pairs and are welded or otherwise fastened to opposite transverse sides of the border wires 31. In the preferred embodiment, the intersections of the longitudinal and transverse grid wires are welded together. Together, the longitudinal wires 32 and the transverse wires 33 define a matrix or array of pockets in the rectangular grid. In this case, each pocket in the array is a rectangular pocket defined between adjacent pairs of longitudinal wires 32 and adjacent pairs of transverse wires 33.

The pad 12 overlies the grid 30. The upper extent of the assembly 10 is covered by the upholstery covering material 11 which is stretched over the pad and usually fastened by staples or similar attaching elements to the underside of the wooden base frame 20.

Supporting the grid 30 above the frame 20 is a plurality of spring elements 40. The spring elements 40 are vertically oriented and spaced in an array between the frame 20 and the grid 30. Each of the spring elements 40 occupies a single position or grid pocket in the array, and there is no more than one of the spring elements 40 in any given pocket or array position. These spring elements 40 are attached at their upper ends to grid 30. The spring elements 40 are attached at the lower ends to the transverse frame elements 22, 23. In such an arrangement, the spring elements provide distributed elastic support to the grid 30 and to a bedding load set upon the upper surface of the box spring assembly 10. Each of the spring elements 40 is independently compressible downward in response to a downward deflection of the point on the grid 30 to which the upper end of the spring element is attached.

Each of the spring elements 40 is what is referred to in the trade as being of a "modular design." That is, each of the spring elements 40 is comprised of multiple interconnected, straight bars or sections, rather than the traditional circular turns of a "coil" spring.

Figure 2:
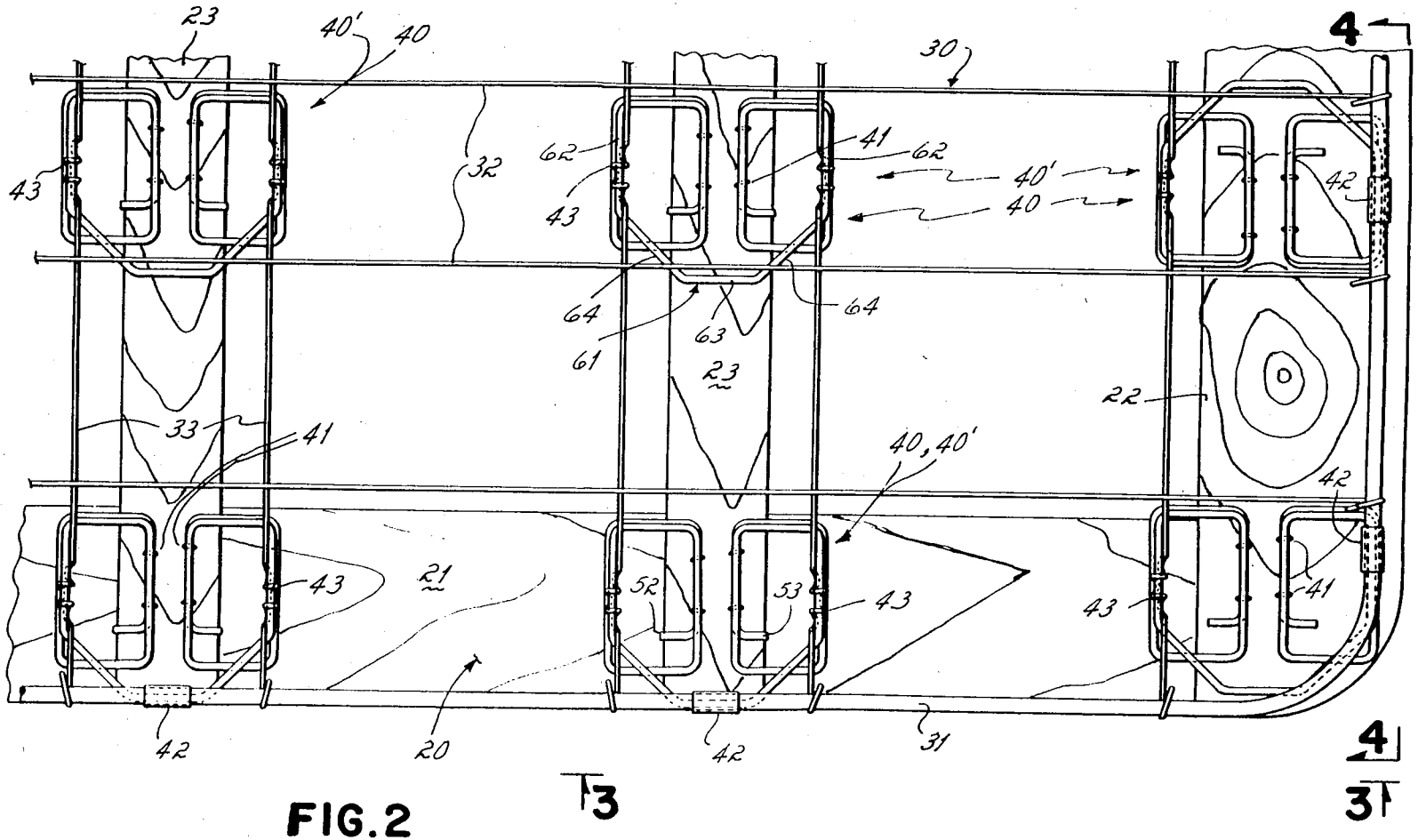
FIG. 2 is an enlarged view of the cutaway section in the lower right-hand corner of the drawing in FIG. 1, showing the interrelation of the frame, grid, and spring components in greater detail.

Referring now to FIG. 2, the transverse end members 21, 22 and slats 23 of the frame 20 are more clearly illustrated. The border wire 31 is illustrated and shown as being of heavier gauge than the longitudinal wires 32 and transverse wires 33 of the grid 30. The spring elements 40 are shown fastened to the transverse frame members 22, 23 by means of staples 41. The upper ends of the spring elements 40 are attached to the wire grid 30. The spring elements 40 at the periphery of the array are attached at their upper ends to the border wire 31 by means of metal clips 42. Each of the spring elements 40 is attached to the transverse grid wires 33 by means of a pair of conventional hooks 43 formed in the transverse wires 33. With reference to FIG. 2, it will be seen that opposite straight end segments 62 of the U-shaped head 61 of each spring element 40 are received in the hook fasteners 43 of the transverse wires 33 of the grid and that the transverse wires pass over the inside of the straight end segments 62 so as to entrap the head 61 of the spring elements beneath the transverse wires 33 of the grid 30, or, in the case of the endmost spring elements 40, is clipped to the end segment of the border wire 31 by the clips 42. The bight section 63 of the head 61 of the spring elements 40 which interconnects the straight end segments 62 passes beneath one of the longitudinal wires 32 of the grid 30, or, in the case of the outermost spring elements 40, is clipped to the border wire 31 by the metal clip 42. Thereby, the spring elements 40 are entrapped beneath and within one pocket of the array of pockets defined by the wire grid 30 and are attached to transverse wires 33 of the grid at opposite sides of the spring elements 40 to provide a balanced load on the spring elements 40 so that they compress uniformly in response to a load on the grid 30.

Figure 5A:
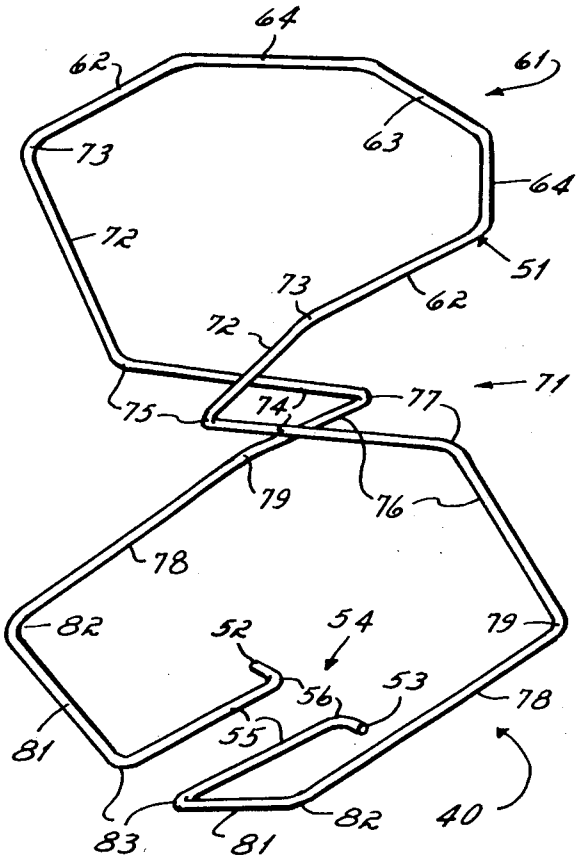
FIG. 5A is a perspective view of the spring element shown in FIGS. 3A and 4A.
Figure 3A:
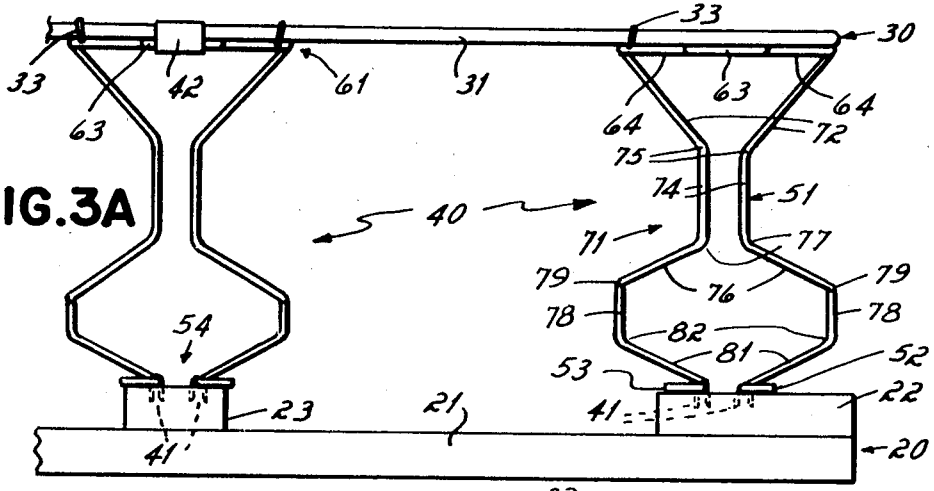
FIGS. 3A and 3B are front elevational views along the line 3—3 of FIG. 2 showing details of the spring elements embodying principles of the present invention.
Figure 4A:
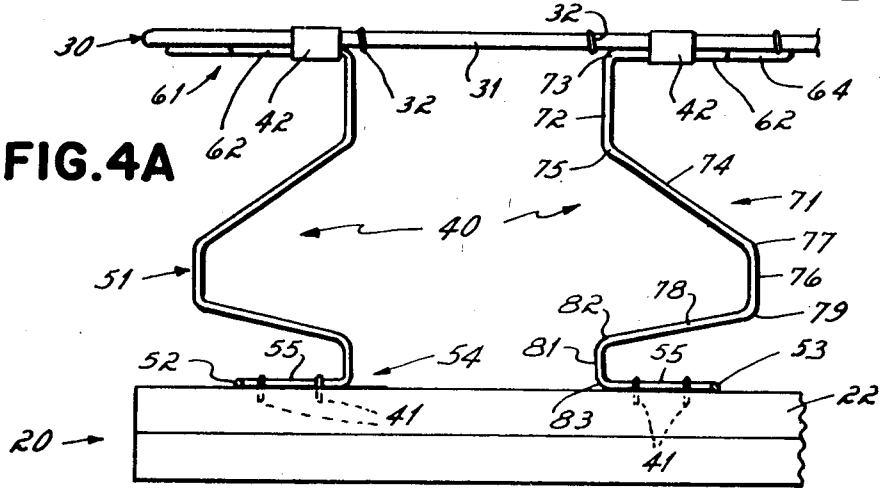
FIGS. 4A and 4B are side elevational views along line 4—4 of FIG. 2 further showing the spring element embodiments illustrated in FIGS. 3A and 3B, respectively.

Referring to FIGS. 3A, 4A and 5A, simultaneously, one of the embodiments of a spring element, according to principles of the present invention, is illustrated in detail. The base frame components 21, 22 and 23 of the frame 20, the border wire 31 of the grid 30, and clip fasteners 42 are illustrated in FIGS. 3A and 4A. The ends of the transverse grid wires 33 are shown in FIG. 3A and the ends of the longitudinal grid wires 32 are shown in FIG. 4A. The spring elements 40 are shown in FIGS. 3A, 4A and 5A. This version of the spring element is hereinafter referred to as the "five-bar angular spring element."

The five-bar angular form of the spring element 40 is integrally formed of a single piece of wire 51, having opposite ends 52 and 53. The wire 51 near both of these ends is shaped in such a way as to form a spring base 54 which is fastened to the wooden frame 20. The base 54 includes a pair of straight sections 55 formed near each of the ends 52 and 53 of the wire 51, and a pair of outwardly turned 90° bends 56 between the straight portions 55 and the ends 52 and 53. The base 54 with its parts 52, 53, 55 and 56 lie in a horizontal plane against the surface of the frame 20. Both of the straight sections 55 of a spring element 40 are attached side by side and close together to one of the base frame elements 22 or 23 beneath one of the pockets of the array defined by the grid 30.

At the upper end of the spring 40 formed in the center of the wire 51 is a U-shaped head 61. The head defines an approximately semi-circular curve formed of five straight segments of the wire 51. The segments include the two straight end segments 62 which are parallel to each other, a transverse section 63 perpendicular to the section 62, and a pair of diagonal sections 64 which are approximately 45° to the sections 62 and 63 and connect them. The straight sections readily receive the flat metal clip fasteners 42 for connection to the border and conform to the curved corners of the border wire 31.

Formed in the wire 51 between the head 61 and the base 54 are a pair of vertical arms 71. In the embodiment shown, the arms 71 and the entire spring element 40 are symmetrical about a vertical plane which bisects the U-shaped head 61 at the midpoint of the head section 61. The arms 71 are formed in the wire 51 between the head 61 and the base 54 in five straight sections or bars. These include a pair of bars 72 adjacent the head section 62 and differentiated therefrom by a pair of bends 73 in the wire 51. A second pair of bars 74 is formed integrally of the wire 51 and differentiated from the bars 72 by a pair of bends 75. A third pair of bars 76 is formed integrally of the wire 51 and differentiated from the bars 74 by a pair of bends 77. A fourth pair of bars 78 is formed integrally of the wire 51 and differentiated from the bars 76 by a pair of bends 79. A fifth pair of bars 81 is formed integrally of the wire 51 and differentiated from the bars 78 by a pair of bends 82, and further differentiated from the sections 55 of the base 54 by a pair of bends 83.

In the embodiment shown in FIGS. 3A, 4A and 5A, the arms 71 are formed so that each of the five bars is inclined to the vertical. In this embodiment, none of the five bars of each of the arms 71 is horizontal and none is parallel to any of the other bars of the same arm. By inclining each of the bars of the arms 71 to the vertical, each will deform in response to torsional or bending stresses on the wire to contribute to the vertical downward deflection of the spring member 40 in response to a bedding load on the grid 30 above. Furthermore, by providing that each of the bars is significantly inclined also to the horizontal and sloped downwardly moving from the head to the base along the wire 51, the space between the grid 30 and the base 20 is spanned effectively, and an efficient use of wire material is achieved to maintain a given design height for the desired resiliency spring element 40. Generally, both advantages are efficiently accomplished by inclining the bars approximately 45° to the vertical.

Figure 5B:
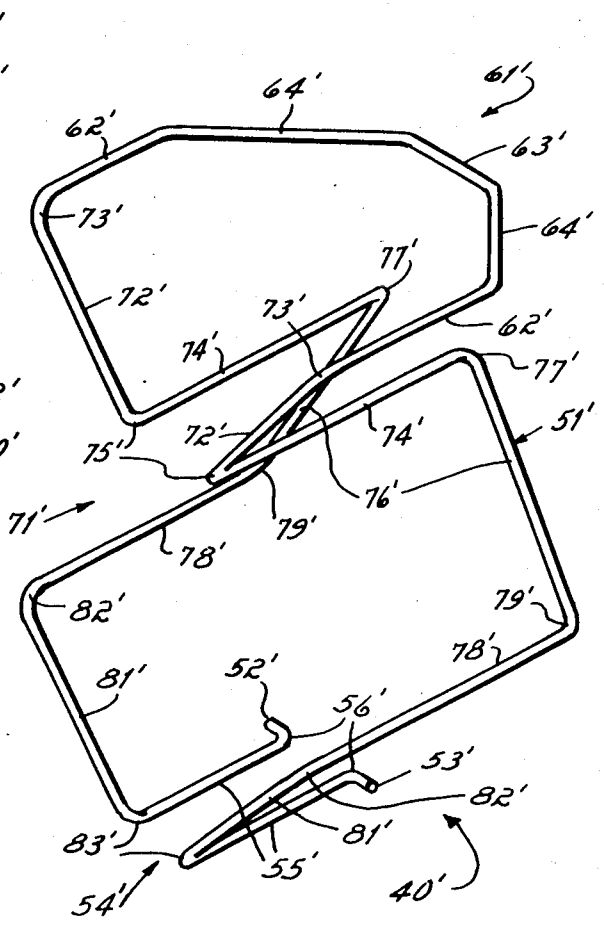
FIG. 5B is a perspective view of a spring element shown in FIGS. 3B and 4B.
Figure 3B:
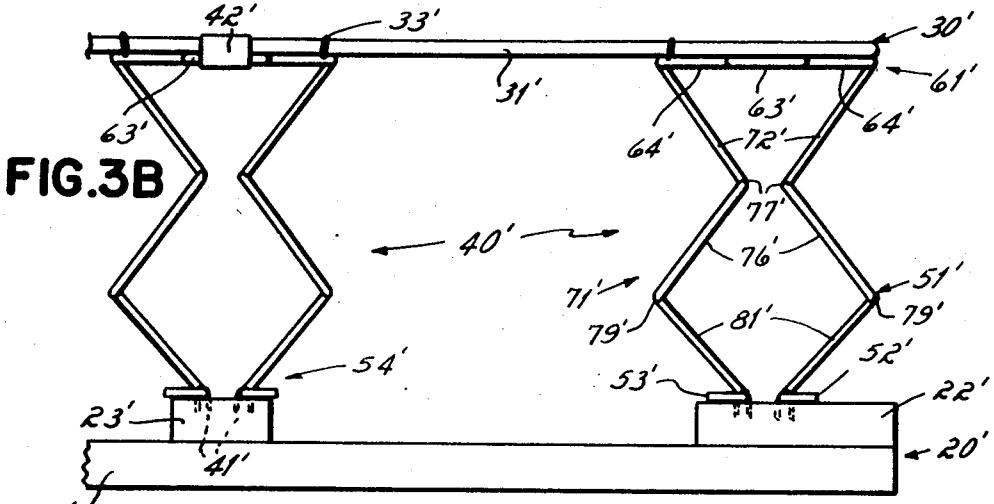
Figure 4B:
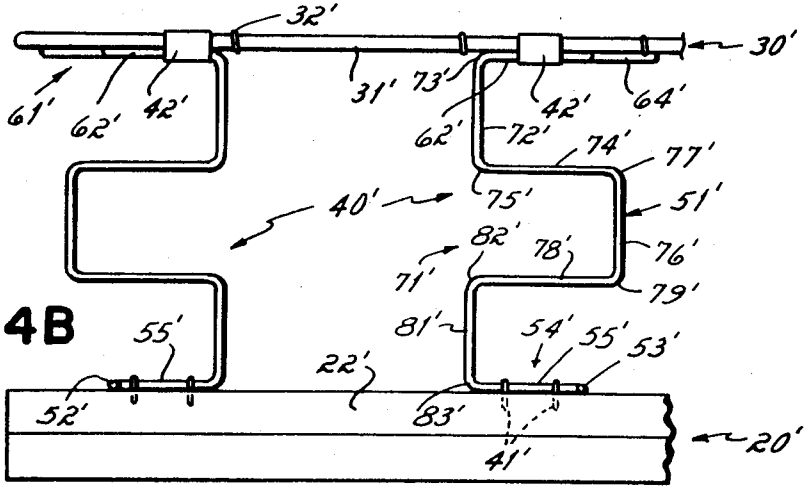

Referring now to FIGS. 3B, 4B and 5B, a second embodiment of the spring elment 40' of the present invention is shown. This embodiment will be referred to as the "five-bar square module." This embodiment emphasizes different characteristics of the invention. In this embodiment, each of the five bars 72', 74', 76', 78' and 81' of the arms 71' are differentiated from the adjacent sections of the wire by generally 90° curves at the wire bends 73', 75', 77', 79', 82' and 83'. In this embodiment, the bars 74' and 78' are horizontal and act as torsion bars in reaction to a load on their spring head 61'.

Both of the angular and square modular versions of the spring element 40, 40' have approximately the same apperance when viewed from the top as illustrated in FIG. 2. Each of the spring arms 71, 71' forms a column disposed to one side of a plane vertically bisecting the member 63, 63' of the head 61, 61'. The curves of the wire 51 are such that, when viewed from above as in FIG. 2, the rotation of the wires in each spring is in the same direction as one follows the wire from one end to the other. Furthermore, each of the bends between the adjacent bars of the arms 71, 71' of the spring elements 40, 40' form angles of approximately 90 degrees when projected on the horizontal plane, as may best be seen in FIG. 2. More particularly, and considering the embodiment of FIGS. 3A, 4A, and 5A, the components of the wire are the components of one-half of the base 54, the components of one of the arms 71, the components of the head 61, the components of the other of the arms 71, and the components of the other half of the base 54. These are, in sequence, the wire end 52, a bend 56, a straight section 55 of the base 54, curve 83, bar 81, curve 82, bar 78, curve 79, bar 76, curve 77, bar 74, curve 75, bar 72, curve 73, head section 62, diagonal head section 64, and the center head section 63. Progressing from the center of the head along the other arm to the base and the other end 53 of the wire 51, the elements are the same in reverse order proceeding from the head 61 to the base 54 and the opposite end of the wire 53. All of the components follow this same rotation viewed from the top as in FIG. 2. Beginning at the end 52, the order selected followed a clockwise rotation along the wire 51. The components of the embodiment of FIGS. 3B, 4B and 5B follow this same sequential rotation.

The spring elements, according to this invention, function as a single spring. The two arms 71 of the spring elements 40 compress downwardly in a similar fashion and do so together in response to a single motion of the head 61 of the element 40. As such, the spring elements provide a superior and very efficient modular substitute for a coil spring in a box spring assembly.

Having fully described the illustrated embodiments of the invention, the following is claimed:

1. A box spring assembly having a rectangular horizontal frame, a rectangular wire grid parallel to and spaced above said frame, a plurality of wire spring elements each connected between said frame and said grid, said wire grid comprising a rectangular border wire, a plurality of spaced, parallel, longitudinal wires, and a plurality of spaced, parallel, transverse wires, said longitudinal wires and said transverse wires extending between and being attached to opposite sides of said border wire, said longitudinal and transverse wires defining an array of rectangular pockets between adjacent pairs of said longitudinal wires and adjacent pairs of said transverse wires, said spring elements being disposed between said frame and said grid for providing distributed elastic support to a bedding load on said grid, each of said spring elements occupying a single and separate pocket in said array, each of said spring elements being integrally formed of a single and separate wire, and each including a base formed on each end of said wire, each of said bases being fastened to said frame, a planar U-shaped head formed in said wire between said ends, said U-shaped head having two parallel sides fastened to opposite sides of a single pocket in said grid and a third side extending between said two parallel sides and underlying and contacting a third side of said single pocket, a pair of vertical arms on each of said spring elements, each of said vertical arms being formed of said wire and extending between said head and said base, each of said vertical arms being connected at the top directly to one of said parallel sides of said U-shaped head and including a plurality of bars angled to the vertical to yieldably resist the downward forces of the bedding load, each of said vertical arms comprising a first connector bar being connected directly to and extending downwardly and inwardly from one end of one of said parallel sides of said U-shaped head toward the first connector bar of the other arm, said first connector bar of both of said arms being located in a common first vertical plane, a second connector bar extending rearwardly away from a lower end of said first connector bar and away from said first vertical plane, said second connector bar of one arm being parallel to the second connector bar of the other arm, a third connector bar extending downwardly and outwardly away from a lower end of said second bar, said third connector bar of both of said arms being located in a second vertical plane, said second vertical plane being spaced from and parallel to said first vertical plane, a fourth connector bar extending forwardly from said lower end of said third connector bar, said fourth connector bar extending from said second vertical plane toward said first vertical plane, said fourth connector bar of one of said arms being parallel to said fourth connecting bar of the other of said arms, and a fifth connector bar extending downwardly and inwardly from the forward end of said fourth connector bar to one end of one base of said wire.

2. The box spring assembly of claim 1 wherein said bars of each of the arms of the spring elements are each angled to the horizontal and to each of the others of said bars of the arm.

3. The box spring assembly of claim 2 wherein each of said spring elements is symmetrical about a vertical plane bisecting said head.

4. The box spring assembly of claim 1 wherein the arms of said element include curves in the wire between the adjacent bars of the arms and between the arms and said base and head and wherein the U-shaped head of each of said spring elements defines curve in the wire of said element, and each of said curves having a common direction of rotation about the vertical from one end of said wire to the other.

5. The box spring assembly of claim 1 wherein the ends of each of said bars of each of said arms connect either to the end of another one of said bars or to said head or said base.

6. The box spring of claim 1 wherein said second connector bar of each of said arms extends downwardly and rearwardly away from said lower end of said first connector bar, and said fourth connector bar extends downwardly and forwardly from said lower end of said third connector bar.

7. The box spring of claim 1 wherein said second and fourth connector bars of both of said arms are torsion bars located in horizontal planes.

8. The box spring of claim 1 wherein said second connector bar of each of said arms extends downwardly and rearwardly away from said lower end of said first connector bar, and said fourth connector bar extends downwardly and forwardly from said lower end of said third connector bar.

9. The box spring of claim 1 wherein second and fourth connector bars of both of said arms are torsion bars located in horizontal planes.

* * * * *